US007191996B2

(12) United States Patent
Patsalaridis

(10) Patent No.: US 7,191,996 B2
(45) Date of Patent: Mar. 20, 2007

(54) SUPPORT DEVICE DESTINED TO BE ANCHORED IN THE GROUND

(76) Inventor: Dimitrios Patsalaridis, 5739 Plantagenet Street, Montréal (Québec) (CA) H3S 2K4

( * ) Notice: Subject to any disclaimer, the term of this patent is extended or adjusted under 35 U.S.C. 154(b) by 175 days.

(21) Appl. No.: 11/009,072

(22) Filed: Dec. 13, 2004

(65) Prior Publication Data

US 2005/0116133 A1 Jun. 2, 2005

(51) Int. Cl.
*F16M 13/00* (2006.01)

(52) U.S. Cl. ..... 248/530; 248/156; 135/16

(58) Field of Classification Search ..... 248/530, 248/545, 156, 533, 87; 52/155, 157, 165; D8/373; D7/707; 256/32, DIG. 5; 135/16, 135/118
See application file for complete search history.

(56) References Cited

U.S. PATENT DOCUMENTS

| | | | | |
|---|---|---|---|---|
| 222,389 | A * | 12/1879 | Earle | 210/131 |
| 261,230 | A | 7/1882 | Hugill et al. | |
| 495,471 | A | 4/1893 | Brown | |
| 1,049,549 | A | 1/1913 | Tesreau et al. | |
| 2,084,239 | A | 6/1937 | Bradford | |
| 2,209,504 | A | 7/1940 | Beiter | |
| 2,347,443 | A | 4/1944 | Vesely | |
| 2,901,789 | A | 9/1959 | Frank | |
| 3,317,168 | A | 5/1967 | Ziph | |
| 3,318,560 | A * | 5/1967 | Garrette, Jr. et al. | 248/545 |
| 4,459,787 | A * | 7/1984 | Wilcox | 52/155 |
| 4,467,575 | A | 8/1984 | Dziedzic | |
| 4,819,904 | A | 4/1989 | Shpigel et al. | |
| 4,832,304 | A | 5/1989 | Morgulis | |
| 4,979,341 | A | 12/1990 | Norman et al. | |
| 5,046,699 | A | 9/1991 | Perreault et al. | |
| 5,358,209 | A | 10/1994 | Ward | |
| 5,482,246 | A * | 1/1996 | Derkoski | 248/530 |
| 5,919,005 | A | 7/1999 | Rupiper | |
| 6,199,569 | B1 | 3/2001 | Gibson | |
| 6,202,368 | B1 | 3/2001 | Wallace, III | |
| 6,685,155 | B1 * | 2/2004 | Chen | 248/533 |
| D518,286 | S * | 4/2006 | Santos | D3/17 |

FOREIGN PATENT DOCUMENTS

| | | |
|---|---|---|
| GB | 2340854 | 3/2000 |
| GB | 2360809 | 10/2001 |

* cited by examiner

*Primary Examiner*—Gwendolyn Baxter
(74) *Attorney, Agent, or Firm*—Francois Martineau

(57) ABSTRACT

The device, destined to be anchored in the ground of granular composition, comprises a rod with a hollow tubular section, the latter having an open upper end wherein can be fixed an object and an intermediate orifice on its flank. The orifice enables evacuation of the granular matter constituting the ground and penetrating into the rod through its open lower end when the device is being anchored in the ground.

6 Claims, 4 Drawing Sheets

SUPPORT DEVICE DESTINED TO BE ANCHORED IN THE GROUND

FIELD OF THE INVENTION

This invention generally relates to support devices and more particularly to a support device which can be anchored into the ground so as to maintain an object fixedly over ground.

BACKGROUND OF THE INVENTION

There are many different shapes of support devices to be anchored into the ground. A review of prior art reveals the existence of several devices which can be anchored into ground, more particularly into soil made of granular compound material, such as earth, sand, snow, or the like. To facilitate reading, we will use occasionally earth as an example of such compound. A large number of support devices exist and are different from one another mainly by the geometry of the support tip destined to be driven into ground.

Among these devices, we will draw attention to support devices which comprise a tubular post with hollow section, which become upright upon being anchored into ground. The lower end of the post destined to be anchored into ground comprises a lower aperture and a thread in the shape of a blade or a helix-shaped pointed bar having the same shape as a non-biased spring, constituting the screwing means into the ground. The upper end comprises an anchoring aperture into which it is possible to anchor a given object such as a sunshade post, for example. By driving into ground the support device by its lower aperture, soil may enter into the tubular post of the support by its lower end, which enables the post to sink more easily, since the soil does not need to be removed as the device is screwed into ground, as is the case for example with a post having a closed conical shape lower end. However, when soil engages and packs itself into the tubular body of the post, it may be difficult to remove this soil therefrom. If the device is used a second time without having released the soil column that has build up the preceding time, a new soil column will form and will upwardly bias the existing previous soil column toward the top of the tubular post; if the device is used several times in such fashion, the tubular post may become completely filled by soil on all its length, so that soil will come to close the anchoring aperture of the upper end of the post, thus preventing the anchoring of the object such as the sunshade.

SUMMARY OF THE INVENTION

The present invention relates to a support device for use in being temporarily anchored into ground, comprising:

- a hollow elongated tubular post defining an upper end and a lower end;
- a first aperture in said post located at said lower end of said post;
- a second aperture in said post located at said upper end of said post; and
- an intermediate outlet aperture in said post located between said first aperture end and said second aperture.

The present invention also relates to a support device for use in being temporarily anchored into ground, comprising:

- an elongated hollow tubular post defining an upper end and a lower end;

- a first aperture in said post located at said lower end of said post;
- a second aperture in said post located at said upper end of said post;
- an intermediate outlet aperture in said post located in between said first aperture and second aperture; and
- a deflector secured to the interior of said post and in register with said outlet aperture and for use in deflecting a granular material flow coming from said first aperture toward said outlet aperture.

In accordance with an embodiment of the invention, the support device further comprises screwing means for said device located on the lower portion of said post, for use in facilitating the anchoring into ground of said device.

Said screwing means may consist of a helix-shaped bar forming a thread fixedly attached to the lower portion of said post.

Said helix-shaped bar may be attached to said post so that a lower portion of said helix-shaped bar does not surround said post but rather freely extends beyond the lower end of said post.

The support device may further comprise a screw arm fixedly secured to the external wall of said post, said arm to be used as a handle to facilitate rotating of said post.

Said arm may be pivotally attached by one of its ends to said post, said screw arm being tiltable between a storage state where said arm is parallel to said post, and an operative extended state, where said arm is orthogonal to said post. Said hollow tubular post preferably defines such an internal surface and said deflector preferably being formed of a plate having a peripheral edge matching said internal surface of said post whereby said plate faces in inclined fashion said outlet aperture.

The present invention also relates to a support device for use in being temporarily anchored into ground, comprising:

- an elongated hollow tubular post defining an upper end and a lower end;
- a first aperture of said post located at said lower end of said post;
- a second aperture of said post located at said upper end of said post; securing means located on the upper portion of said post, enabling to maintain in place another object engaged into said second aperture of said post;
- screwing means for said device located on a lower portion of said post, for use in enabling anchoring said device into ground;
- an intermediate aperture located in said post and located between said first aperture and said second aperture; and
- deflector means secured to the interior of said post and in register with said intermediate aperture;
- said device for use into ground comprising granular material; said post for use in enabling such granular material constituting the ground to engage and build up into said hollow section of said post by said first aperture thereof upon its ground anchoring, said deflector means for use in preventing free flow of the granular material climbing along said post from said first aperture toward said second aperture, and said deflector means for use in biasing the granular material from said first aperture toward said intermediate aperture.

DETAILED DESCRIPTION OF THE EMBODIMENTS OF THE INVENTION

FIGS. 1 to 4 show the support device 10 of the invention, for use on a ground S of granular material, and for use in supporting an object not part of the invention, for example a sunshade, fixedly over ground.

The support device 10 comprises a hollow tubular section post 12 defining two ends: a lower end corresponding to the end which may be anchored into ground S, and an upper end, opposite the lower end.

A lower aperture 14 is formed at the lower end of the post 12. An upper aperture 16 is formed at the upper end of the post 12.

Figure 1:
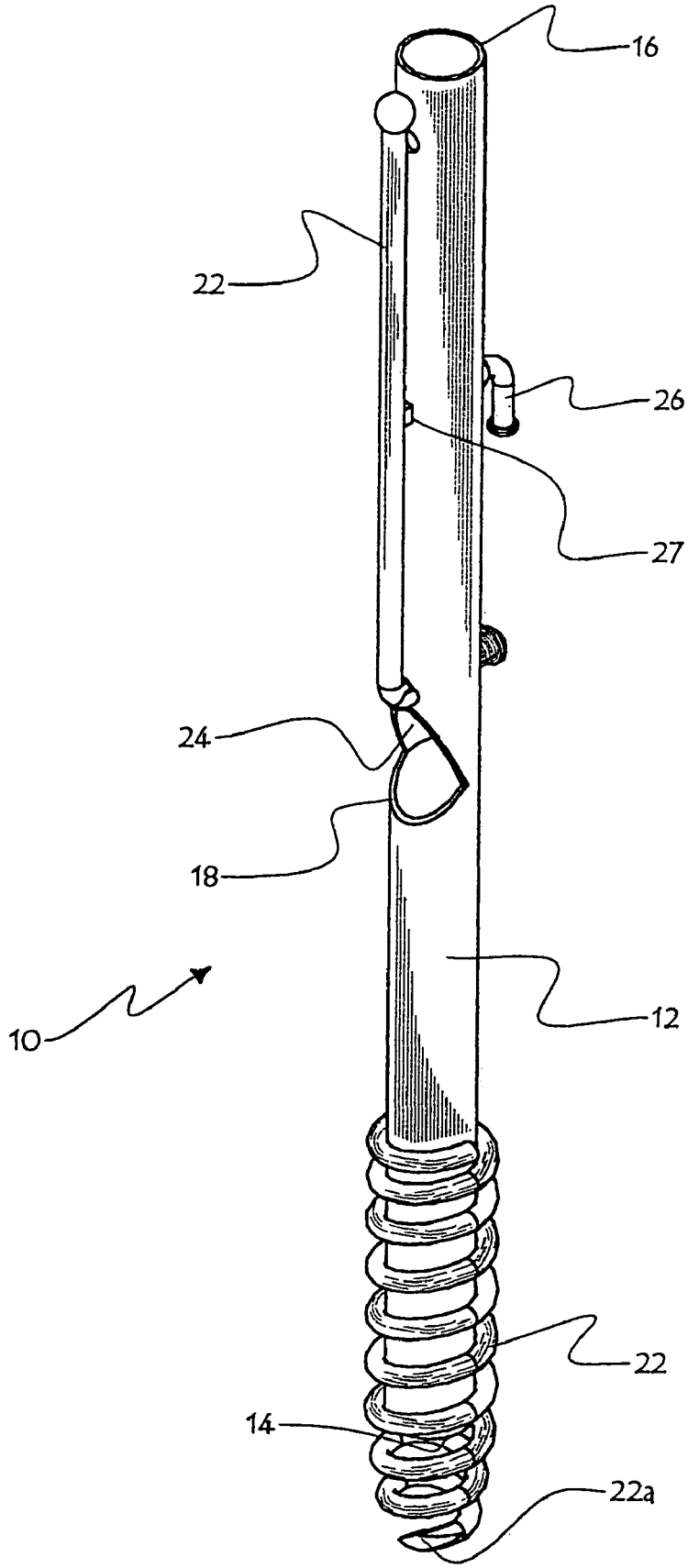
FIG. 1 shows a perspective view of the support device of the invention, with its screw arm in folded condition.

A pointed-tip helix-shaped bar 22 is fixedly attached to the lower portion of the post 12, as shown in FIG. 1. This helix-shaped bar 22 represents a screw means for the device 10. The helix-shaped bar 22 is for use in assisting the user of device 10 to anchor device 10 into ground S. The purpose of helix-shaped bar 22 is similar to that of the threads of a screw. A lower converging portion 22*a* of helix-shaped bar 22 extends downwardly beyond the lower end of the post 12 to facilitate the anchoring of device 10 into ground S. Once the lower portion 22*a* of the helix-shaped bar 22 has been driven into ground S, the portion of post 12 surrounded by helix-shaped bar 22 may then engage into ground S more easily. Since the body of post 12 itself is cylindrical and hollow, the effective surface resisting to the sinking is very small.

Post 12 includes an intermediate aperture 18 on its side, between apertures 14 and 16 and spaced therefrom.

Moreover, post 12 is provided with a deflector 24 in the shape of an ovoidal metallic plate, deflector 24 being fixedly secured inside the hollow body of post 12, and its peripheral edge matching the internal wall of post 12. Deflector 24 is oriented obliquely inside post 12, so that it comes to register with aperture 18 in an inclined fashion. The highest part of deflector 24 comes in register with the upper part of the periphery of aperture 18.

Figure 2:
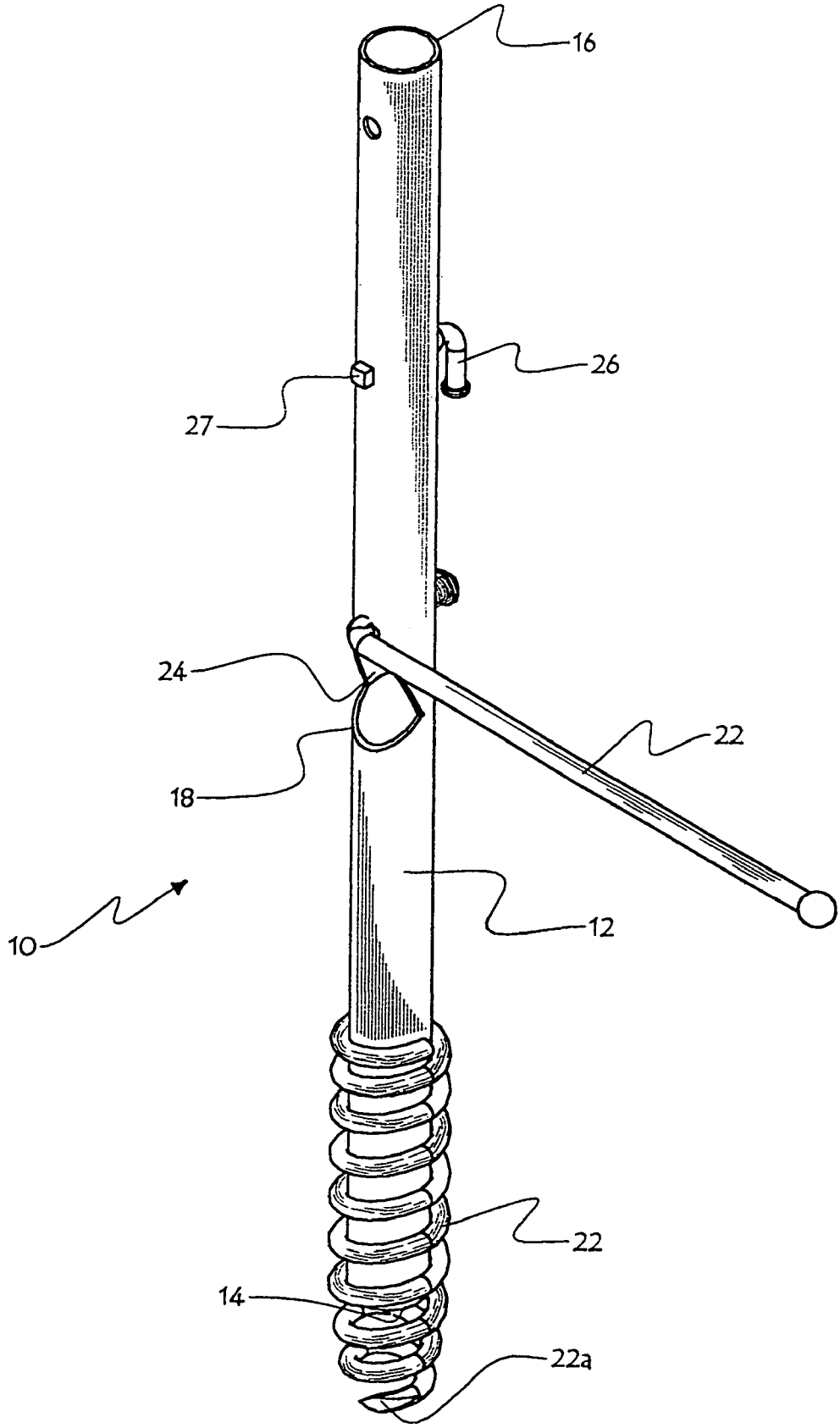
FIG. 2 shows a perspective view of the support device with its screw arm in its extended operative position.
Figure 3:
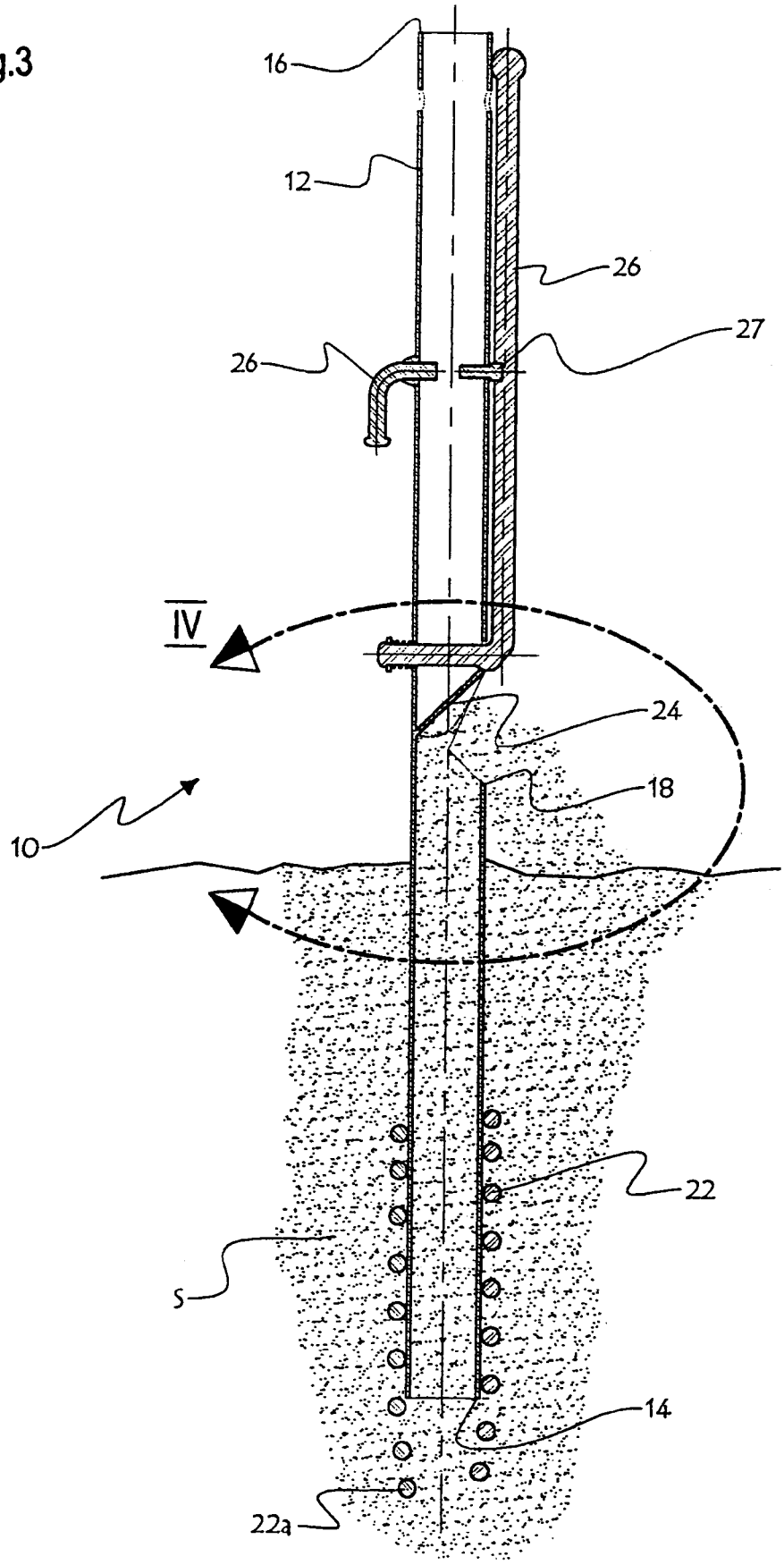
FIG. 3 shows a longitudinal section of the support device anchored into ground, and furthermore suggesting overflow of granular material escaping from an aperture located on the side of the device.
Figure 4:
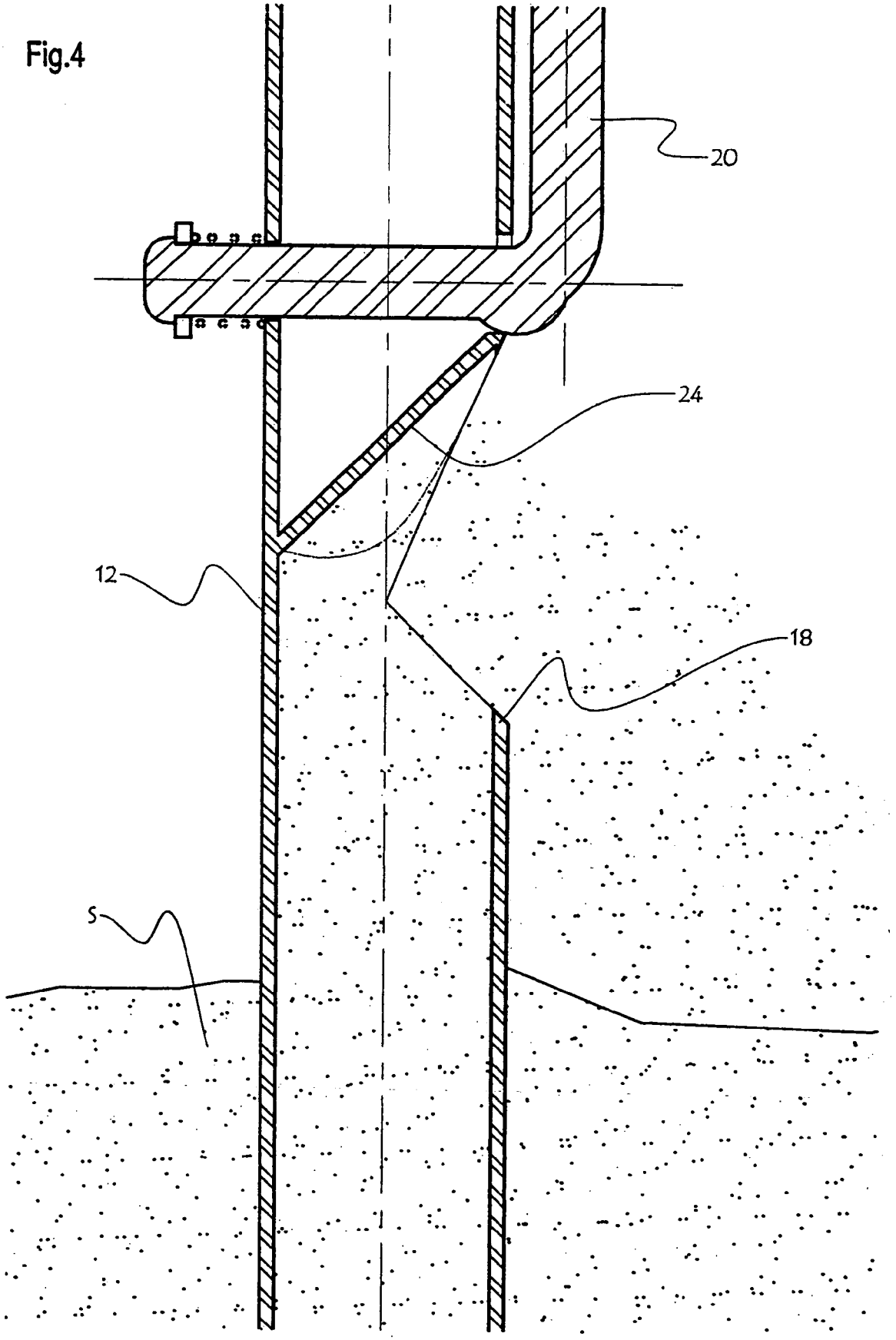
FIG. 4 is an enlarged view of area IV of FIG. 3.

An elongated screw arm 20 is pivotally mounted to post 12 by one of its ends. The anchoring point between arm 20 and post 12 is located between aperture 18 and upper end 16, for example directly above aperture 18 as shown. This arm 20 may pivot between two limit positions: a folded position, where arm 20 is parallel to post 12, and where the free end of arm 20 is oriented upwardly of post 12, as shown in FIG. 1; and an extended operative position, where arm 20 is orthogonal to post 12, as shown in FIG. 2. This arm 20 will promote rotation of device 10 around its central symmetrical axis. Arm 20 is thus a lever arm promoting application of a moment of rotation in post 12, and thus the screwing of device 10 in ground S.

Two tightening screws 26 and 27 are provided on post 12. These two screws 26 and 27 come in facing register and on diametrally opposite positions on post 12. The purpose of screws 26 and 27 is to maintain in place by screwing an object engaged into a hollow section of post 12 through aperture 16, for example the lower end of the post from a sunshade.

The support device 10 operates as follows: the arm 20 is first pivoted in an operative position. Thereafter, the lower tip of the helix-shaped bar 22 abuts against the ground S. The device 10 is then repeatedly rotated around its central symmetrical axis. Each rotation performed by device 10 contributes to the driving of helix-shaped bar and of post 12 into ground S, the helix-shaped bar acting as a thread. The support device 10 may be driven to a desirable depth; nevertheless, the intermediate aperture 18 must remain above ground level S at all times.

As the device is progressively driven into ground S, the granular material forming ground S will engage into post 12 by lower aperture 14. A soil column will thus gradually build up inside post 12. This column may be more or less difficult to release therefrom, depending upon the type of material forming soil S. Since the material forming soil S is not diverted but rather engages into post 12, the center of gravity of device 10 is thus lowered, which contributes to improvement in the securing strength into ground S of device 10.

Once device 10 is driven into ground S at the desired depth, arm 20 is tilted toward its folded position. An object, having a securing shaft, such as a sunshade for example, may then be temporarily or permanently secured to the support. We will continue our description hereinbelow with reference to this sunshade as an example of object fixedly mounted over ground, being understood however that any object which may be fixedly secured to post 12 could be used with device 10.

The lower end of securing shaft of the object is engaged in post 12 by upper aperture 16, and is maintained in place by way of tightening screws 26 and 27, which, once screwed, apply a sufficient pressure on the object securing post to tightly maintain same in place.

To store the device 10, the above-noted steps are to be followed, but in reverse order.

The soil column formed during a preceding use of device 10 may have remained at least partially inside the hollow body of post 12. If device 10 is withdrawn and screwed again afterward into ground S, additional soil will come to engage into post 12 by its lower end 14. (The soil column will thus become higher and higher inside post 12, until it reaches the level of intermediate aperture 18. Deflector 24 prevents outflow of raising granular material coming from the ground S, beyond the intermediate aperture 18, and thus prevents closure of upper aperture 16, which will enable engagement of an object through aperture 16. The soil column is indeed gradually deflected by deflector toward aperture 18 and discharged by post 12 through aperture 18 progressively as the new soil engages through the lower end 14.

The helix-shaped bar 22 may be replaced by an alternate anchoring means. In accordance with one embodiment of the invention, the helix-shaped bar 22 is welded onto post 12. However, it could also have been devised alternately not to include a helix-shaped bar 22, the driving into ground S of the device 10 then being performed by applying hammer or mallet blows on the upper end of post 12.

In accordance with one embodiment of the invention, arm 20 could be of a different shape as the one described hereinabove. A removable arm, with one end being engaged in a socket located on the side of post 12 when one wishes to screw the device 10 into ground S, for example, could have been devised. Alternately, the support device 10 could have been developed without any screw arm 20.

The tightening screws 26 and 27 could be replaced by alternate securing means. For example, a push button could have been placed inside the upper part of post 12. The tubular post of the object to be supported would then comprise through-bores on its lower portion, one of which being able to accommodate and receive the push-button located on post 12, thus maintaining the object in place.

Any other modification to the present invention which do not deviate from the general scope of the hereinenclosed claims would be considered as being included.

The invention claimed is:

1. A support device for use in being temporarily anchored into the ground, comprising:

an elongated hollow tubular post defining an upper end and a lower end;

a first aperture in said post located at said lower end of said post;

a second aperture in said post located at said upper end of said post;

an intermediate outlet aperture in said post located in between said first aperture and said second aperture, and a deflector secured to the interior said post and in register with said outlet aperture and for use in deflecting a granular material flow coming from said first aperture toward said outlet aperture;

said support device further comprising screwing means for said device located on the lower portion of said post, for use in facilitating the anchoring into the ground of said device.

2. A support device as defined in claim 1, wherein said screwing means consists of a helix-shaped bar forming a thread fixedly attached to the lower portion of said post.

3. A support device as defined in claim 2, wherein said helix-shaped bar is attached to said post so that a lower portion of said helix-shaped bar dose not surround said post but rather freely extends beyond the lower end of said post.

4. A support device as defined in claim 1, further comprising a screw arm fixedly secured to the external wall of said post, said arm to be used as a handle to facilitate rotating of said post.

5. A support device as defined in claim 4, wherein said arm is pivotally attached by one of its ends to said post, said screw arm being tiltable between a storage state where said arm is parallel to said post, and an operative extended state, where said arm is orthogonal to said post.

6. A support device comprising:

an elongated hollow tubular post defining an upper end and a lower end;

a first aperture of said post located at said lower end of said post;

a second aperture of said post located at said located at said upper end of said post;

securing means located on the upper portion of said post, enabling to maintain in place another object engaged into said second aperture of said post;

screwing means for said device located on a lower portion of said post, for use in enabling anchoring of said device into ground;

an intermediate aperture located in said post and located between said first aperture and said second aperture; and deflector means secured to the interior of said post and in register with said intermediate aperture:

said device for use into ground consisting of granular material; said post for use in enabling such granular material constituting the ground to engage and build up into said hollow section of said post by said first aperture thereof upon its ground anchoring, said deflector means for use in preventing free flow of the granular material climbing along said post from said first aperture toward said second aperture, and said deflector means for use in biasing this granular material from said first aperture toward said intermediate aperture.

* * * * *